US005392683A

United States Patent [19]

Farley

[11] Patent Number: 5,392,683

[45] Date of Patent: Feb. 28, 1995

[54] METHOD AND APPARATUS FOR THREE DIMENSIONAL BRAIDING

[75] Inventor: Gary L. Farley, Yorktown, Va.

[73] Assignee: The United States of America as represented by the Administrator of the National Aeronautics and Space Administration, Washington, D.C.

[21] Appl. No.: 953,562

[22] Filed: Sep. 29, 1992

[51] Int. Cl.[6] ..... D04C 3/00

[52] U.S. Cl. ..... 87/8; 87/37; 87/51

[58] Field of Search ..... 87/8–11, 87/33–37, 41, 42, 50, 51, 55–57

[56] References Cited

U.S. PATENT DOCUMENTS

| | | | |
|---|---|---|---|
| 2,197,111 | 4/1940 | Muller | 87/50 |
| 3,426,804 | 2/1969 | Bluck | 87/33 X |
| 3,894,470 | 7/1975 | Reichel | 87/50 X |
| 4,096,781 | 6/1978 | Bock et al. | 87/50 X |
| 4,312,261 | 1/1982 | Florentine | 87/33 |
| 4,614,147 | 9/1986 | Vendramini | 87/5 |
| 4,615,256 | 10/1986 | Fukuta et al. | 87/33 |
| 4,719,837 | 1/1988 | McConnell et al. | 87/1 |
| 4,881,444 | 11/1989 | Krauland | 87/8 |
| 4,885,973 | 12/1989 | Spain | 87/1 |
| 4,916,997 | 4/1990 | Spain | 87/1 |
| 4,922,798 | 5/1990 | Ivsan et al. | 87/8 |
| 4,972,756 | 11/1990 | Du et al. | 87/56 |
| 4,984,502 | 1/1991 | Spain et al. | 87/8 |

*Primary Examiner*—Joseph J. Hail, III

*Attorney, Agent, or Firm*—Linda B. B. Blackburn

[57] ABSTRACT

A machine for three-dimensional braiding of fibers is provided in which carrier members travel on a curved, segmented and movable braiding surface. The carrier members are capable of independent, self-propelled motion along the braiding surface. Carrier member position on the braiding surface is controlled and monitored by computer. Also disclosed is a yarn take-up device capable of maintaining tension in the braiding fiber.

13 Claims, 7 Drawing Sheets

METHOD AND APPARATUS FOR THREE DIMENSIONAL BRAIDING

ORIGIN OF THE INVENTION

The invention described herein was made by an employee of the United States Government and may be used by or for the Government for governmental purposes without the payment of any royalties thereon or therefor.

BACKGROUND OF THE INVENTION

1. Field of the Invention

This invention relates generally to methods and apparatuses for braiding articles and more specifically to three-dimensional braiding of fibers useful inter alia as fiber reinforced structural preforms.

2. Description of the Related Art

Braiding apparatuses generally consist of a braiding surface upon which travel a plurality of yarn carrier members which dispense the braiding fibers. The braiding fibers generally intersect in an area near the article being braided, hereafter referred to as the braiding zone.

Various braiding surfaces have been developed, with the majority being a simple flat plane, as disclosed in U.S. Pat. No. 4,881,444. Flat surfaces have the disadvantage that extremely large surface areas may be needed to accommodate a moderate range of braiding angles. In addition, flat braiding surfaces cause difficulties in maintaining yarn tension, since carrier members at different braid angles require different length yarns. To address this difficulty, some braiding machines have curved braiding surfaces that attempt to maintain constant yarn tension by maintaining the carrier members at a constant distance from the braiding zone.

Various braiding patterns are possible by manipulation of carrier member positions on the braiding surface. Many devices use a push/pull mechanism to change the carrier positions of entire rows or columns of carrier members, as disclosed in U.S. Pat. No. 4,885,973. Other devices use self-propelled carriers traveling in a fixed pattern determined by a preset track arrangement, as disclosed in U.S. Pat. No. 4,972,756.

Most braiding machines incorporate some features to maintain yarn tension and to rewind yarn. A common means to accomplish these goals is a coil spring or an electric motor with a friction coupling.

SUMMARY OF THE INVENTION

It is accordingly an object of this invention to provide a braiding machine capable of achieving a wide range of arbitrary weave angles in order to fabricate three-dimensional braided articles.

More specifically, this invention is directed to a braiding machine comprising a curved, segmented and movable braiding surface whereby the curved surface effectively allows a wider range of braiding angles than can be obtained with a flat braiding surface of comparable area. A plurality of individually self-propelled carrier members move across the braiding surface by movement from pivot disc to pivot disc. The motion of the carrier members is electronically monitored and controlled by computer. The yarn carriers have dedicated motors which control yarn tension and allow unlimited yarn rewind.

DESCRIPTION OF THE PREFERRED EMBODIMENTS

Figure 1:
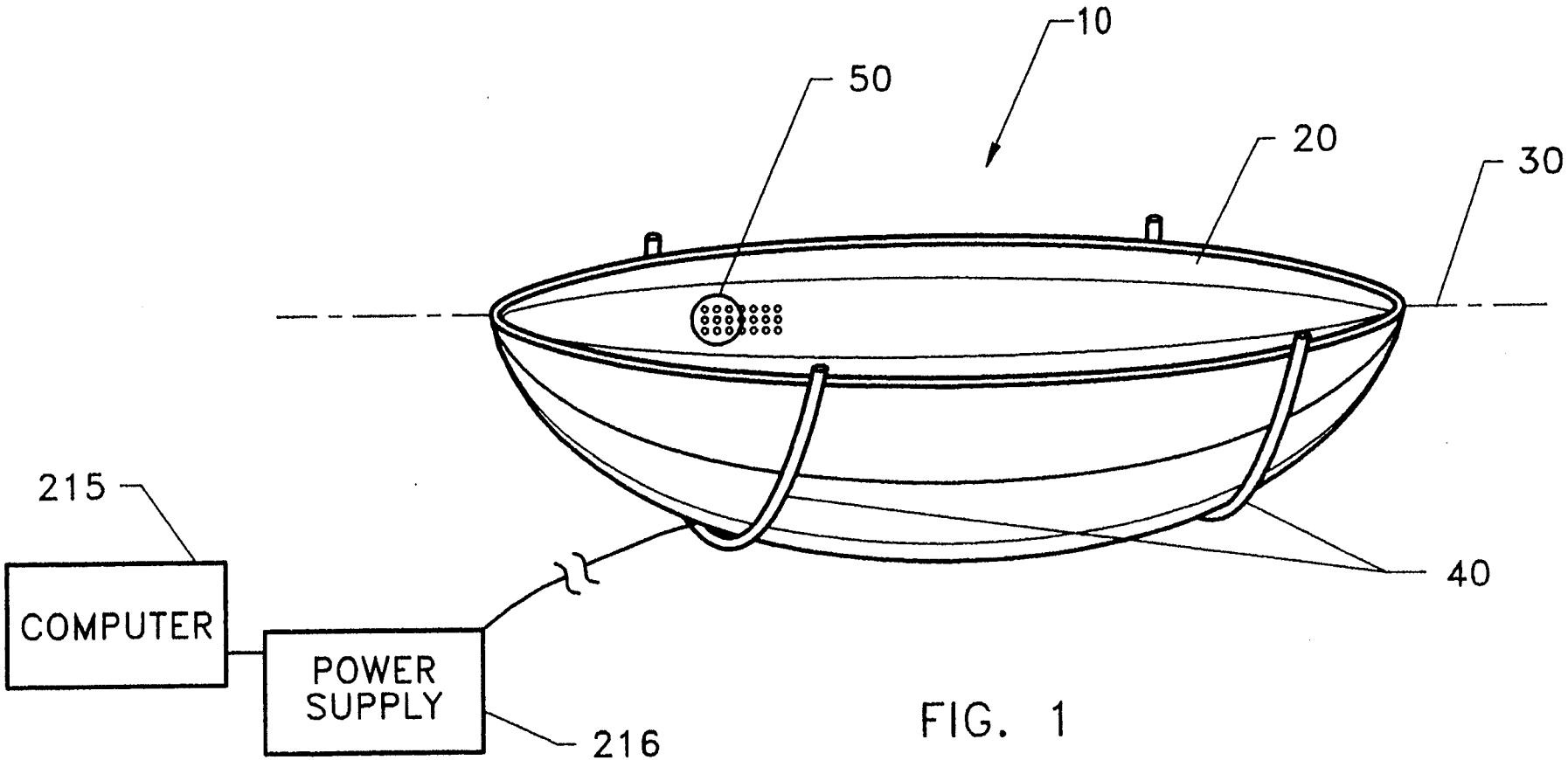
FIG. 1 is a front view of a curved, multi-segmented braiding surface.

Braided articles of this invention are preferably made on an apparatus that consists of a concave inner braiding surface 10 such as that shown in FIG. 1. The braiding surface consists of movable segments 20 which are capable of rotation about an axis 30 through a desired arc of rotation. The concave surface 10 can be any partial or full surface of rotation. The concave inner surface 10 can of course consist of curved and flat portions. The segments 20 are supported and guided in their revolution by stationary guide rails 40. Rotation of the individual segments 20 may be accomplished by hydraulic or pneumatic actuators, electric motors or other conventional mechanisms which may be located at any convenient location such as between the guide rail 40 and the convex surface of the braiding segment 20. Pivot discs 50 are situated on the concave surfaces of the braiding segments 20. The shape of the braiding surface 10, the mobility of the braiding segments 20 and the individual control of carrier members 150 facilitates the unique placement of fibers that heretofore has been unattainable except by manual manipulation of yarns, as discussed below.

Figure 2:
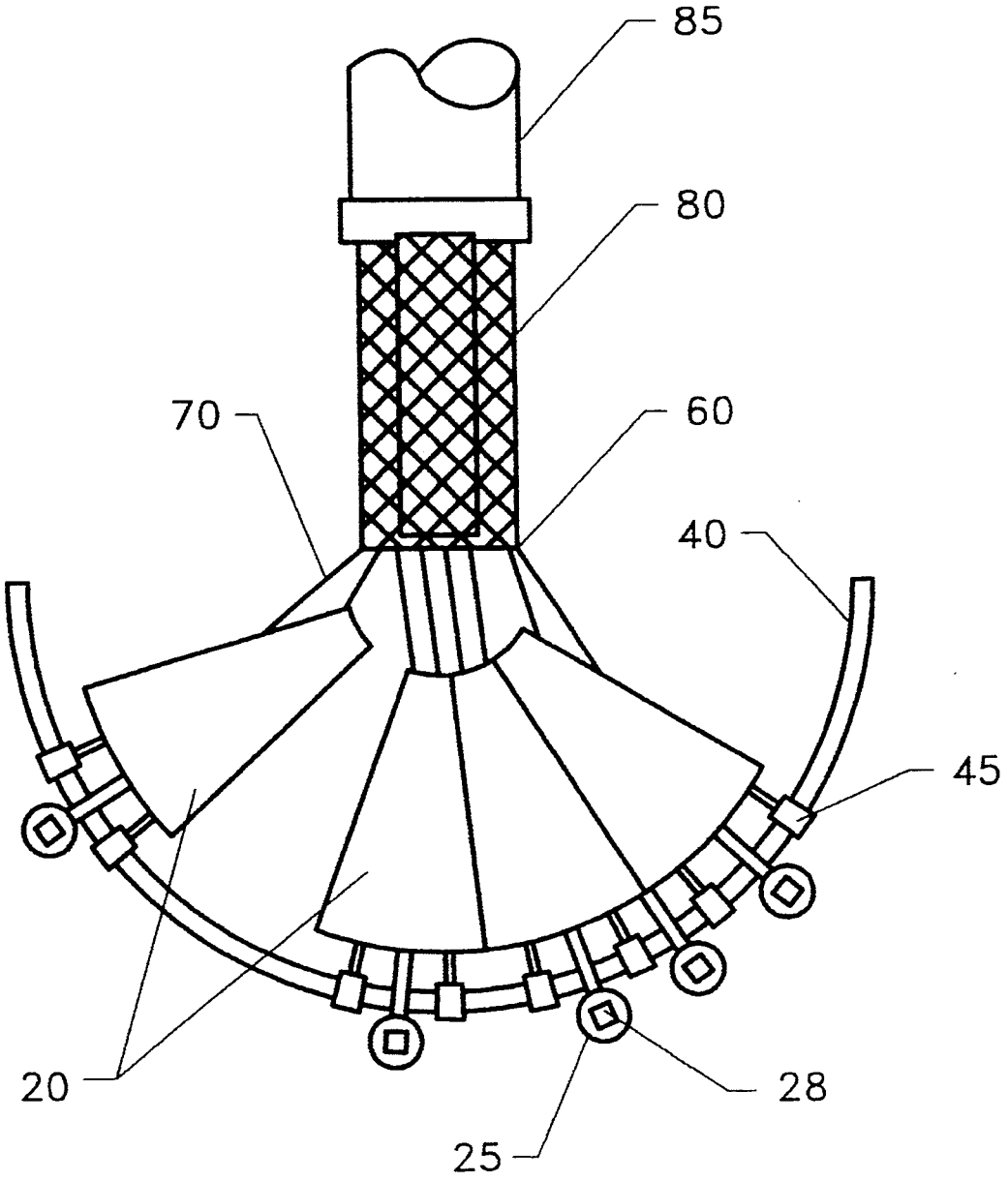
FIG. 2 is an end view of the curved braiding surface demonstrating movement of several braiding segments.

The end view of the braiding apparatus shown in FIG. 2 illustrates various positions of the segments 20 on the guide rail 40 in relation to the braiding zone 60 formed by the fiber strands of the article 80 being braided. Guide rings 45 secure the segments 20 on the guide rails 40. Guide mechanisms 25 such as a grooved wheel are powered by a motor 28, fixedly connected to movable segments 20, and travel along guide rails 40. The motor is powered by a power supply 216 controlled by a computer 215 in the same manner as shown in FIG. 1.

Figure 3:
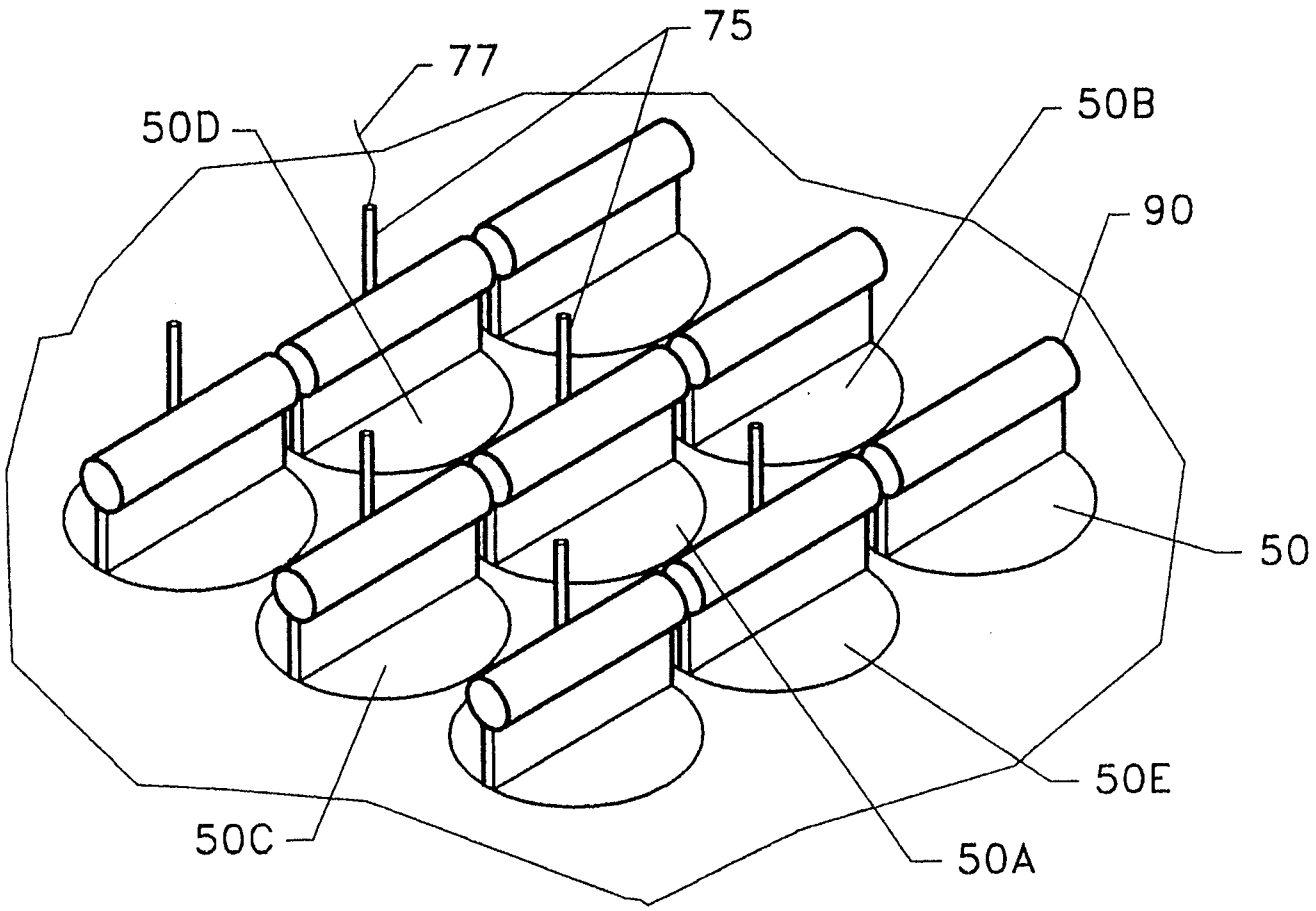
FIG. 3 is a perspective of several pivot discs which lie on the braiding surface.

FIG. 3 illustrates the layout of evenly spaced, non-translating pivot discs 50 on the concave surface of the braiding segments 20. The braiding surface 20 consists of an assemblage of pivot discs 50. Along the flat or singularly curved regions of the braiding segments 20 the pivot discs 50 are evenly spaced. However, on the region of the braiding surface 10 with double curvature some of the rows of pivot discs 50 are omitted. Deleting rows along the doubly curved region of the braiding surface 10 limits the amount of movement between rows that is capable in this region. Each pivot discs 50 is capable of rotation through $\pm 180°$ about its center point, i.e., about an axis perpendicular to the concave side of the braiding surface 20 as discussed below. Situated on the pivot discs 50 are linear shafts 90 which can be longitudinally aligned with similar shafts 90 on adjacent pivot discs 50 by rotation of the discs 50. Non-braiding yarn tubes 75 extend through the braiding segments 20 between the pivot discs 50 to guide unidirectional non-braiding fibers 77 for the braided article 80. By extending these yarns through the braiding surface, the need for separate tractor/yarn carriers for these yarns is eliminated, thereby further reducing the required braiding area.

Figure 4:
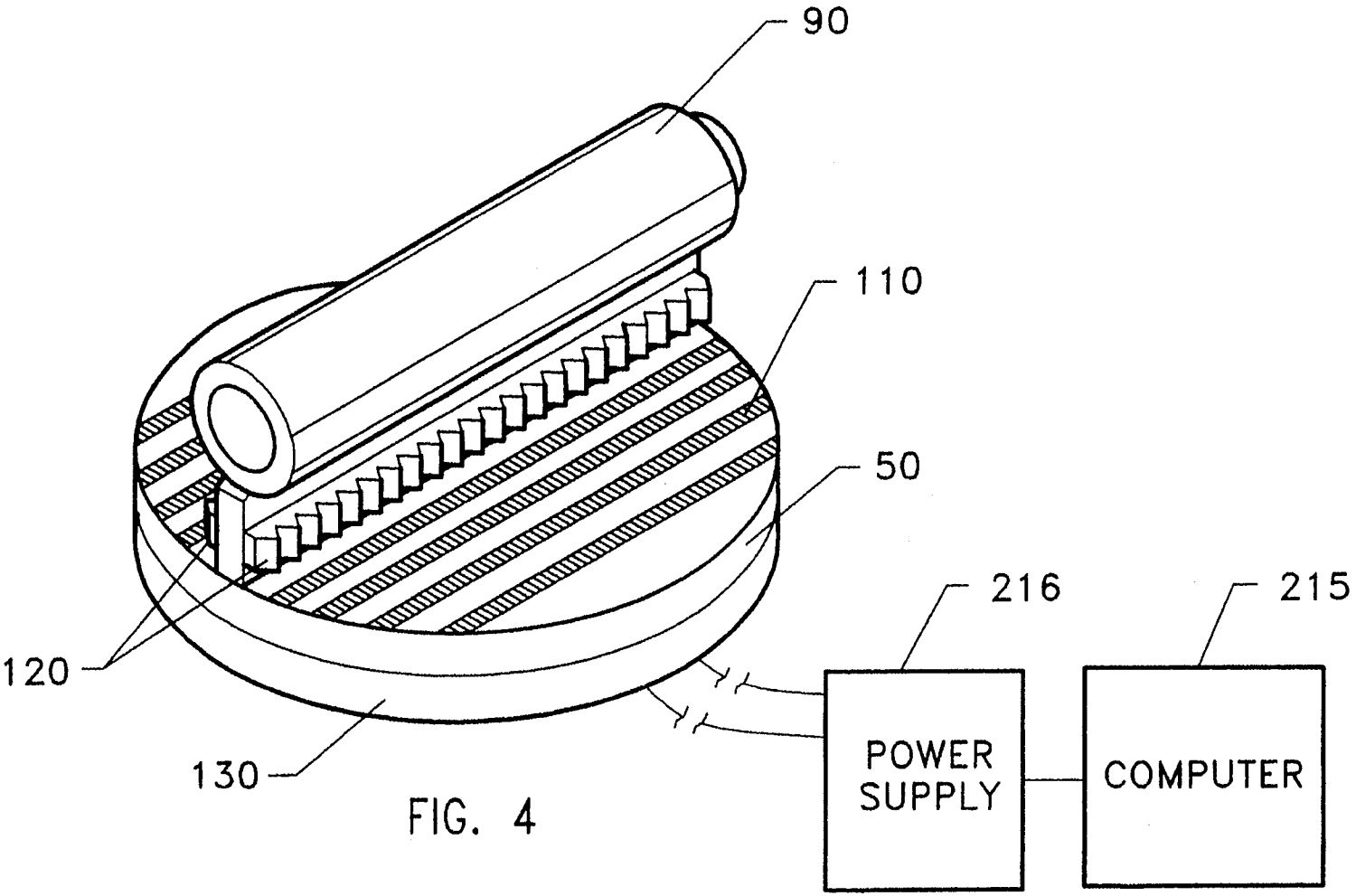
FIG. 4 is a detailed drawing of a typical pivot discs.

FIG. 4 shows additional details of a pivot disc 50. The surface of the disc 50 has electrical power and sensor contact strips 110. The linear shaft 90 is flanked by shaft gears 120 which are used to facilitate movement of carrier members 150 discussed below. Below the pivot disc 50 is a stationary support disk 130 which houses a conventional stepper motor or rotary solenoid (not shown) which turns the pivot disc 50.

Figure 5:
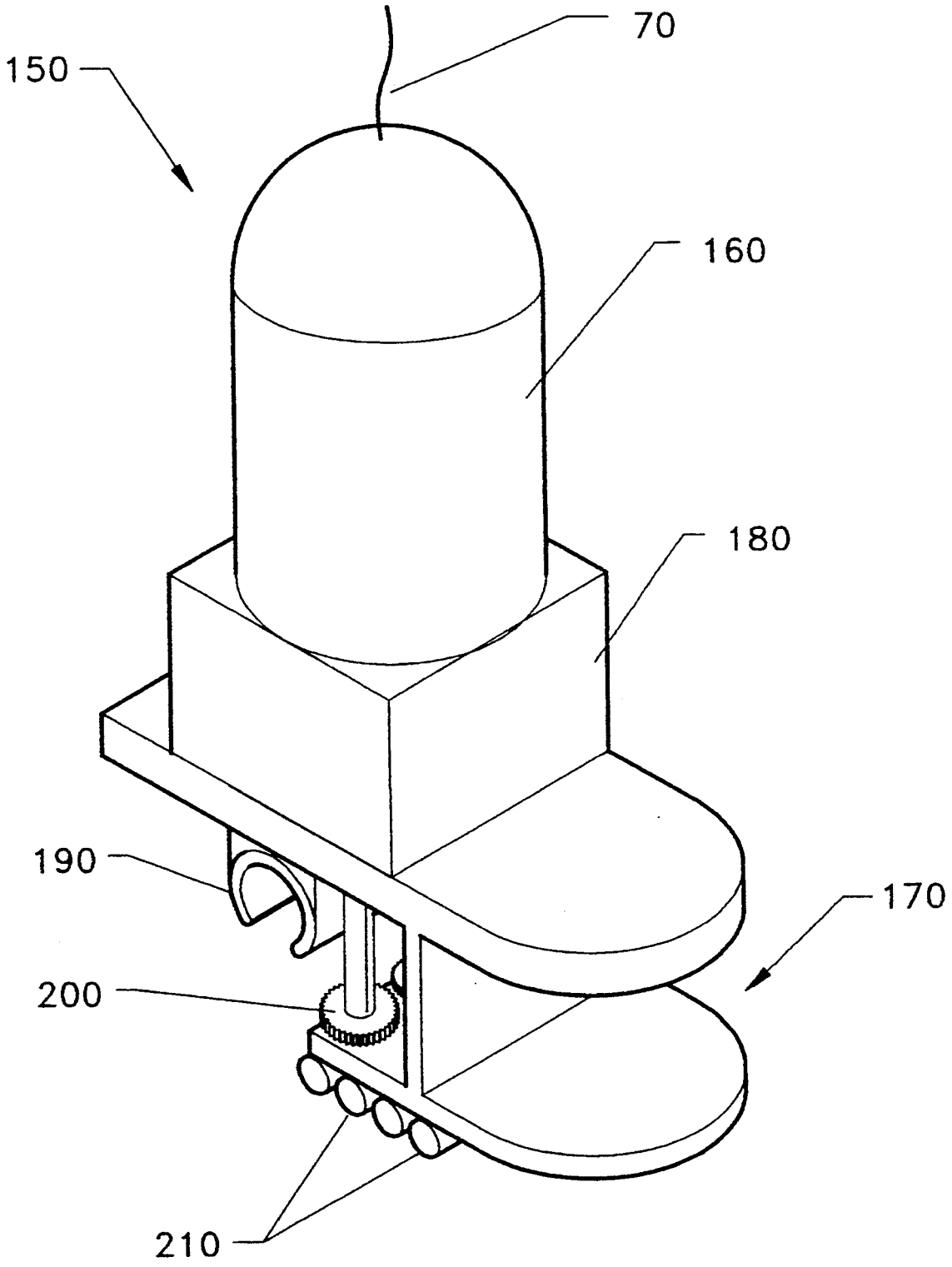
FIG. 5 is a drawing of a carrier member assembly.

FIG. 5 illustrates a carrier member 150 which travels on the concave side of the braiding surface 10 from pivot disc 50 to pivot disc 50. The carrier member 150 consists of a yarn carrier 160, which dispenses a fiber strand 70, and a tractor assembly 170. The tractor assembly 170 has a linear motion bearing 190 which guides the carrier member 150 on linear shafts 90. Independent propulsion of each carrier member 150 is accomplished by an electric motor 180 which operates a drive gear 200 which intermeshes with shaft gears 120. The motor 180 is powered through integral electrical power and sensor contacts 210 and is controlled by a computer 215 through a power supply 216. The computer 215 is programmed to activate power at the carrier members 150, yarn carriers 160 and braid segments 20 in a sequence determined by the braiding pattern required to construct a given article. When power is turned on at a pivot point electrical current goes from the pivot point through the electrical contacts 110 and 210 and to the motor 180 on the carrier member 150. The shaft of the motor turns the gears in the gear head assembly and the drive gears 200. The drive gears 200 mesh with the rack gears 120 on the pivot disc 50. When the drive gears 200 turn the carrier member 150 moves.

Referring to FIG. 3, three different carrier member 150 movements are possible; a carrier member 150 (not shown in FIG. 3) located on pivot disc 50A may advance forward to pivot disc 50B, turn to the left or right and advance to pivot disc 50D or 50E, and turn +180° and advance to the pivot disc 50C behind the original location. To advance forward to the next pivot disc 50B the computer 215 must turn on the electrical power at the first pivot disc 50A. The carrier member 150 moves forward onto the next pivot disc 50B until the electrical contacts 210 of the carrier member 150 no longer make contact with the contacts 110 on the first pivot disc 50A. The computer 215, through monitoring the current levels on the first pivot disc 50A, turns the power off at the first pivot disc 50A and turns on the power at the second pivot disc 50B. Once the carrier member 150 is completely on the second pivot disc 50B the computer 215 turns off the power at the second pivot disc 50B.

To move the carrier member 150 to the pivot discs 50D or 50E to the right or left of the original pivot disc 50A, it is first necessary to rotate both pivot discs 50A and 50D or 50A and 50E 90° so that the longitudinal axes of horizontal shafts 90 mounted on the pivot discs 50A and 50D or 50A and 50E line up with each other. It is important to insure that the pivot discs 50 are rotated in phase so that the carrier member 150 will not be facing the wrong direction after the transfer is complete. The computer 215 turns the electrical power on at the first pivot disc 50A and the carrier member 150 advances to the designated second pivot disc 50D or 50E. When electrical contact no longer exists between the first pivot disc 50A and the carrier member 150, the computer 215 turns the electrical power off at the first pivot disc 50A and on at the second designated pivot disc 50D or 50E. Once the carrier member 150 is positioned correctly on the second pivot disc 50D or 50E, the computer 215 reorients both pivot discs 50A and 50D or 50E.

In the third case the computer 215 rotates the first pivot disc 50A 180° and the carrier member 150 advances to the second pivot disc 50C in a similar manner as is done in the other cases. After the carrier member 150 is correctly positioned onto the second pivot disc 50C, the computer 215 reorients the first pivot disc 50A.

Figure 6:
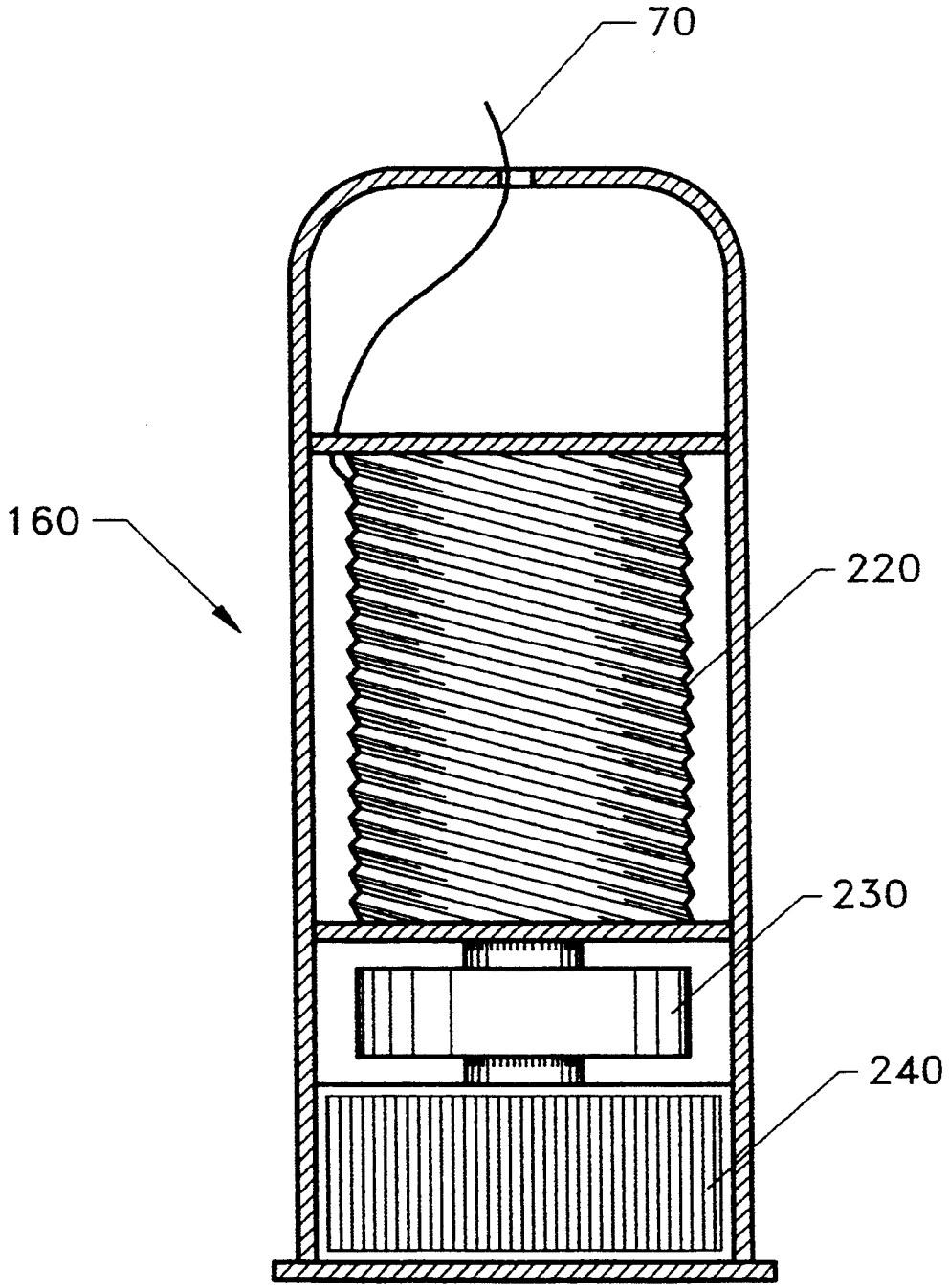
FIG. 6 is a cutaway drawing of a typical carrier member assembly.

FIG. 6 illustrates a yarn carrier 160 which is mounted on the top of a carrier member 150 and dispenses a braiding fiber strand 70. The fiber 70 is wound on a spool 220 prior to the mounting of the yarn carrier 160 onto the carrier member 150. Yarn 70 is pulled from the yarn carrier 160 as the carrier member 150 is moved around the braiding surface 10. Tension is maintained in the yarn 70 to eliminate the beat up process by incorporating a friction coupling 230 and a rewind mechanism 240. An electric motor or coil spring 240 may be used to rewind the fiber 70. As the yarn 70 is being pulled out of the carrier 160 the coil spring 240 has already been contracted to its limit. Therefore, tension increases in the yarn 70 until the torque on the spool 220 exceeds the resisting torque supplied by the friction coupling 230. The yarn 70 is then pulled out of the carrier 160 when the tension in the yarn 70 exceeds the resisting force supplied by the friction coupling 230. During the braiding operation there are times when a movement of the carrier member 150 does not result in the extraction of yarn 70 from the carrier 160. Therefore, to maintain tension in the yarn 70 a rewind mechanism must exist and hence the coiled spring 240. The coiled spring 240 rewinds the yarn 70 when the tension in the yarn 70 diminishes.

Figure 7:
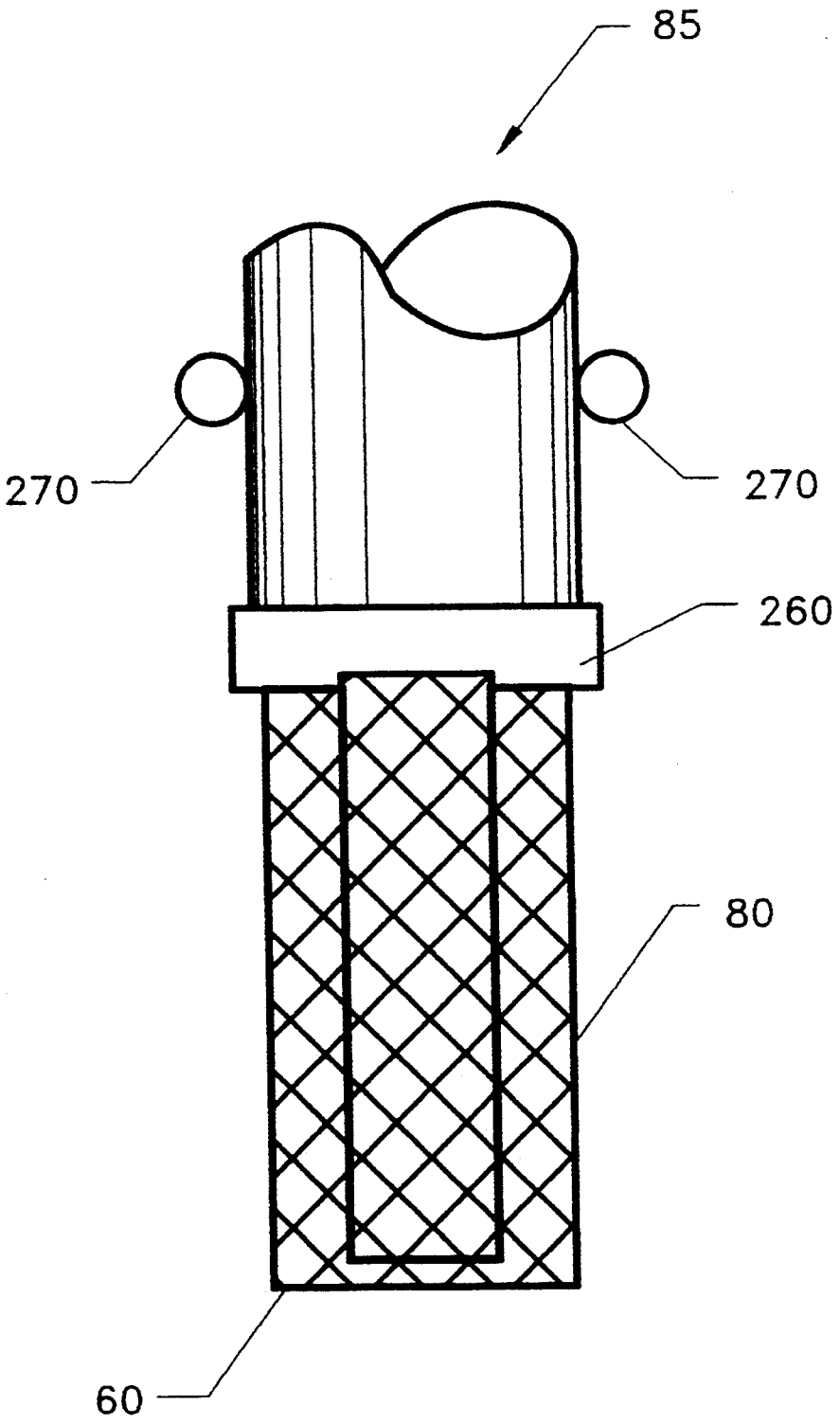
FIG. 7 is a view of a material takeup system.

In order to maintain a constant distance between the braiding zone 60 and the braiding surface 10 and to maintain tension of the braiding yarns 70, a material takeup system 85 is required. Maintaining a constant distance between the braiding zone 60 and the braiding surface 10 permits accurate control of yarn braid angles. Differing preform geometries require different customized takeup systems. Referring to FIG. 7, if a flat preform 80 is being braided a clamp 260 secures the top of the preform 80 and a simple set of tension rollers 270 advances the preform 80. As the preform 80 is braided the tension rollers 270 periodically rotate, in accordance with the braid length, and advance the material. However, if a curved I-beam is braided then the takeup system (not shown) would consist of a series of small movable tension rollers that advance the outer surface of the I-beam at a faster rate than the inner surface of the I-beam.

The programming required to achieve the desired movements of the segments 20, pivot discs 50 and the carrier members 150 is specifically tailored to the particular braiding pattern. The functions described above define the range of motion for each element and specific operating parameters are implemented straightforwardly.

The computer 215 also controls the position of the movable braiding segments 20. Certain yarns may be used as non-braiding yarns 77 and it may be necessary for the braiding segments 20 to be rotated to facilitate the insertion of the yarn 77. There are other potential examples where the braiding segments 20 must be moved. It is possible that the braiding segments 20 may be rotated such that the carrier members 150 are inverted.

In the braiding process a fault condition could occur with one of the carrier members 150 or yarn carriers 160. For example, one of the yarn carriers 160 could have a yarn 70 breakage. A fault sensor (not shown) in the yarn carrier 160 signals the computer 215 that a problem existed and the computer 215 could stop the braiding process and signal the operator that a fault condition existed. The computer 215 could, by a graphical means, show which carrier member 150 or yarn carrier 160 signaled the problem. The operator would instruct the computer 215 to move the carrier member 150 to a position where the problem could be corrected or the computer 215 could rotate a braiding segment 20 and the operator manually correct the problem.

Even with the most sophisticated computers and state-of-the-art electronics, the braiding of complex structural preforms will be a slow process. The necessary fabrication efficiency will only be achievable when the entire process of braiding is automated from the original design of the preform to the final braiding of the preform. A designer from a Computer Aided Design (CAD) station preferably designs the structural preform 80. Prior to braiding the preform 80 the design undergoes computer braiding simulation to validate the design. After the design has been validated, the appropriate number of yarn carriers 160 are wound with yarn 70. Each yarn carrier 160 contains a specific amount of yarn 70 that is a function of the path the yarn travels in the braided preform 80. Each yarn carrier 160 is bar coded and stored until the setup of the braider commences. Each yarn carrier 160 is mounted to a carrier member 150, sensors tested, yarn tension set and then moved onto the braider 20. The computer 215 directs the movement of the carrier member 150 (as discussed above) to the correct starting pivot disc 50 on the braider surface 20. A robotic arm (not shown) extracts the end of the yarn 70 from the cap of the yarn carrier 160 and mounts it onto the material takeup system 85. The process of positioning carrier members 150 and mounting the yarn ends 70 onto the material takeup system 85 is repeated until all the carrier 150 members are correctly positioned onto the braider 20. When nonbraiding yarns 77 are used in a preform design the operator inserts these yarns 77 through the appropriate yarn tubes 75 on the braiding surface 20 and the robotic arm attaches the yarn ends 77 to the material takeup system 85.

Once the braider has been strung the braiding begins. While a preform 80 is being braided additional yarn carriers 160 are being wound with yarn 70, bar coded and stored for the next preform.

Many improvements, modifications and substitutions will be apparent to the skilled artisan without departing from the spirit and scope of the present invention as described herein and defined in the following claims.

I claim:

1. An apparatus for forming an article by intertwining a plurality of fiber strands, wherein said fibers intersect in a braiding zone where said article is being formed, comprising:

(a) a braiding surface;

(b) a plurality of pivot discs situated on said braiding surface, wherein said pivot discs are capable of rotation about an axis perpendicular to said braiding surface;

(c) a plurality of linear shafts, each respectively situated lengthwise on each of said pivot discs for supporting movable carrier members;

(d) a plurality of carrier members movably disposed on said linear shafts, wherein each carrier member dispenses a length of fiber strand extending from said carrier member to the braiding zone of said article being formed; and (e) means for rotating said pivot discs such that the longitudinal axes of adjacent linear shafts are aligned to facilitate transfer of carrier members between adjacent pivot discs.

2. An apparatus for forming an article by intertwining a plurality of fiber strands, wherein said fibers intersect in a braiding zone where said article is being formed, comprising:

(a) a braiding surface;

(b) a plurality of pivot discs situated on said braiding surface wherein said pivot discs are capable of rotation about an axis perpendicular to said braiding surface;

(c) a plurality of linear shafts, each respectively situated lengthwise on each of said pivot discs for supporting movable carrier members;

(d) a plurality of carrier members movably disposed on said linear shafts, wherein each carrier member dispenses a length of fiber strand extending from said carrier member to the braiding zone of said article being formed; and (e) rotators for turning said pivot discs such that the longitudinal axes of adjacent linear shafts are aligned to facilitate transfer of carrier members between adjacent pivot discs.

3. An apparatus for forming an article by intertwining a plurality of fiber strands, wherein said fibers intersect in a braiding zone where said article is being formed, comprising:

(a) a curved braiding surface which is segmented along one axis thereof, whereby the segments are capable of movement about said axis through an arc of revolution;

(b) fiber dispensers, situated on the concave side of the segments of said braiding surface;

(c) means for moving the segments of said braiding surface through a desired am of revolution;

(d) a plurality of carrier members movably disposed on a concave side of said segments of said braiding surface, wherein each carrier member dispenses a length of fiber strand extending from said carrier member to the braiding zone of said article being formed;

(e) means for moving carrier members on said segmented braiding surface;

(f) means for controlling carrier member position on said braiding surface;

(g) a plurality of pivot discs situated on a concave side of said braiding surface, wherein said pivot discs are capable of rotation about an axis perpendicular to the concave side of said braiding surface;

(h) a plurality of linear shafts each respectively situated lengthwise on each of said pivot discs for supporting movable carrier members; and (i) means for rotating said pivot discs such that the longitudinal axes of adjacent linear shafts are aligned to facilitate transfer of carrier members between adjacent pivot discs.

4. The apparatus according to claim 3 further comprising:

(a) a plurality of linear gears disposed on each side of said linear shafts, wherein the longitudinal axes of said linear gears are parallel to the longitudinal axes of said linear shafts; and (b) a plurality of drive gears disposed on said carrier members, wherein said linear gears and said drive gears intermesh to move carrier members.

5. The apparatus of claim 3 wherein independent motors propel each carrier member along said linear shafts between said pivot discs.

6. The apparatus of claim 5 wherein a computer controls and monitors each carrier member position on said braiding surface.

7. The apparatus of claim 3 wherein a computer controls and monitors each carrier member position on said braiding surface.

8. An apparatus for forming an article by intertwining a plurality of fiber strands, wherein said fibers intersect in a braiding zone where said article is being formed, comprising:

(a) a curved braiding ,surface which is segmented along one axis thereof, whereby the segments are capable of movement about said axis through an arc of revolution;

(b) fiber strand dispensers situated on the concave side of said braiding segments;

(c) actuators for moving the segments of said braiding surface through a desired arc of revolution;

(d) a plurality of carrier members movably disposed on a concave side of said segments of said braiding surface wherein each carrier member dispenses a length of fiber strand extending from said carrier member to the braiding zone of said article being formed;

(e) actuators for moving carrier members on said segmented braiding surface;

(f) controllers for positioning carrier members on said braiding surface;

(g) a plurality of pivot discs situated on a concave side of said braiding surface wherein said pivot discs are capable of rotation about an axis perpendicular to the concave side of said braiding surface;

(h) a plurality of linear shafts each respectively situated lengthwise on each of said pivot discs for supporting movable carrier members; and (i) rotators for turning said pivot discs such that the longitudinal axes of adjacent linear shafts are aligned to facilitate transfer of carrier members between adjacent pivot discs.

9. The apparatus according to claim 8 further comprising:

(a) a plurality of linear gears disposed on each side of said linear shafts; and (b) a plurality of drive gears disposed on said carrier members, wherein said linear gears and said drive gears intermesh to move carrier members.

10. The apparatus of claim 8 wherein independent motors propel each carrier member along said linear shafts between said pivot discs.

11. The apparatus of claim 10 wherein a computer controls and monitors each carrier member position on said braiding surface.

12. The apparatus of claim 8 wherein a computer controls and monitors each carrier member position on said braiding surface.

13. A method for forming an article by intertwining a plurality of fiber strands wherein said fibers intersect in a braiding zone where said article is being formed, comprising:

(a) disposing a plurality of movable carrier members on a concave side of a curved braiding surface, said braiding surface being segmented along one axis thereof and rotatable about said axis through an arc of revolution;

(b) rotating braiding surface segments as necessary to achieve a desired braid angle;

(c) propelling said carrier members along adjacent pivot discs on said braiding surface to intertwine fiber strands in a desired braiding pattern, said discs being capable of rotation to permit motion of said carrier members in a forward direction, in a backwards direction and ±90 degrees from the forward direction.

* * * * *